United States Patent [19]

Matt

[11] Patent Number: 4,592,181

[45] Date of Patent: Jun. 3, 1986

[54] ANCHORING OF FREELY OSCILLATING TENSION ELEMENTS OF STEEL OF A DYNAMICALLY STRESSED STRUCTURAL COMPONENT

[75] Inventor: Peter Matt, Ittigen, Switzerland

[73] Assignee: Losinger AG, Bern, Switzerland

[21] Appl. No.: 726,899

[22] PCT Filed: Aug. 15, 1984

[86] PCT No.: PCT/CH84/00128

§ 371 Date: Apr. 15, 1985

§ 102(e) Date: Apr. 15, 1985

[87] PCT Pub. No.: WO85/01080

PCT Pub. Date: Mar. 14, 1985

[30] Foreign Application Priority Data

Aug. 22, 1983 [CH] Switzerland ..... 4567/83

[51] Int. Cl.[4] ..... E04C 3/10

[52] U.S. Cl. ..... 52/223 L; 52/230

[58] Field of Search ..... 52/223 L, 230, 223 R; 24/122.6

[56] References Cited

U.S. PATENT DOCUMENTS

| | | | |
|---|---|---|---|
| 3,866,273 | 2/1975 | Brandestini et al. | 52/223 L X |
| 4,023,242 | 5/1977 | Roqueta | 52/223 L X |

FOREIGN PATENT DOCUMENTS

| | | |
|---|---|---|
| 2753112 | 5/1979 | Fed. Rep. of Germany . |
| 1553466 | 1/1969 | France . |
| 1556234 | 2/1969 | France . |
| 430135 | 8/1967 | Switzerland . |
| 482080 | 1/1970 | Switzerland . |
| 541693 | 10/1973 | Switzerland . |
| 1064458 | 5/1967 | United Kingdom . |

*Primary Examiner*—Carl D. Friedman

*Attorney, Agent, or Firm*—Oldham, Oldham & Weber Co.

[57] ABSTRACT

The tension elements (4) of a tension member of steel are anchored at their ends in an anchor body (1), through whose bores (2) running parallel to one another are led, by means of wedge clamps (3). The diameter (D) of each bore (2) in its section (2*c*) is constant and larger than that (d) of the tension element (4). For the purpose of taking-up of deflecting forces, an elastically yielding ring (5) is provided for in the deflection region of the anchor body (1), which ring is accommodated in a circular recess (11) in the wall of the exit end (2*b*) of each bore (2). In the deflection region of the spreader ring (9), where the tension elements (4) run together into a bunch, an insert (10) is provided for, the material of which is softer than that of the spreader ring (9) or of the tension elements (4). Likewise the material of the ring (5) is softer than the material of the anchor body (1) or of the tension elements (4). In this anchoring, the deflecting forces acting upon the tension elements (4) are eliminated both on the first and on the second deflection location.

8 Claims, 5 Drawing Figures

Figure 1:
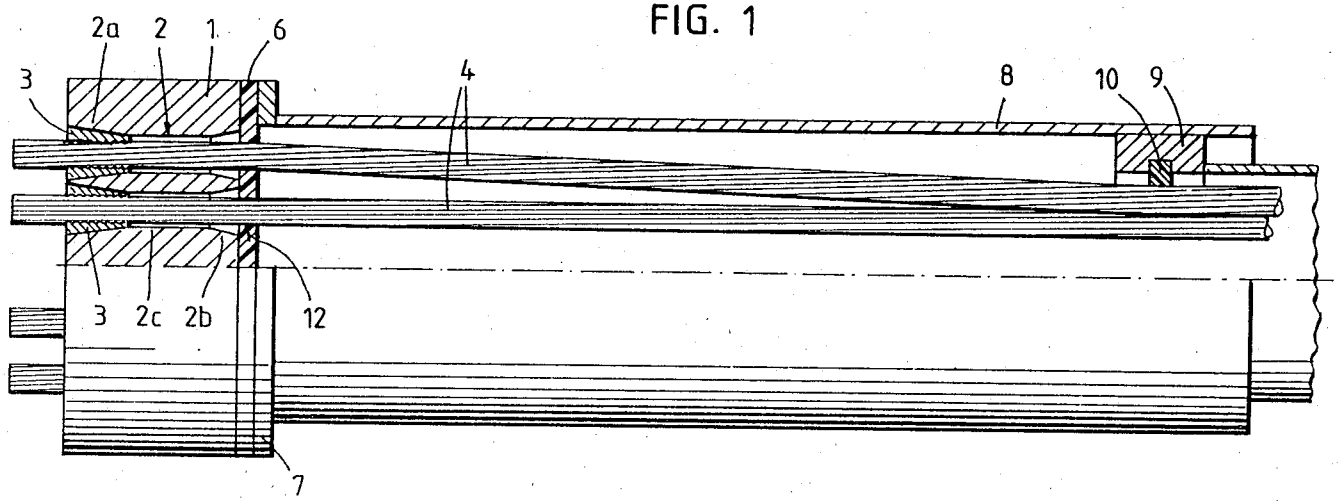

ANCHORING OF FREELY OSCILLATING TENSION ELEMENTS OF STEEL OF A DYNAMICALLY STRESSED STRUCTURAL COMPONENT

The invention starts from an anchoring of freely oscillating tension elements of steel of a dynamically stressed structural component, which tension elements are deflected twice in the anchoring region, having an anchor body with bores running parallel to one another, through which the tension elements are led and are anchored by means of wedge clamps at their ends in spaces of the bores opening conically outwards, supporting means against which the tension elements rest being provided for the deflection region of the anchor body for the purpose of taking-up of deflecting forces, and having a spreader ring for bunching the tension elements exiting from the anchor-body bores and running through the spreader ring.

The anchoring of a taut tension member for heavy loads in a concrete structural component is described in the DE-OS 27 53 112. The part of the tension member lying within the concrete structural component has no bonding to the concrete structural component because it is surrounded by a casing pipe. This part of the tension member can therefore be removed from the concrete structural component after the unloading and disengagement of its anchoring. A later exchangeability of the tension member, which is e.g. a guying cable of a cable-stayed bridge, is thereby made possible if the guying cable has become defective. By means of this solution, however, the breaking damage through deflecting forces acting upon the guying cables is not eliminated, and the fatigue strength of the guying cables is not increased.

The teaching according to CH-PS 541 693 attempts to eliminate these disadvantages. For the purpose of taking up the deflecting forces of the wires running together into a bunch behind the anchor body, supporting means against which the wires rest are inserted in the deflection region of the anchor body. Moreover, these supporting means centre the wires relative to the anchor body in a predetermined position. For this purpose, the supporting means are inserted in the spaces between the wires and the respective bore wall and fill these spaces up. The supporting means consist of a material which is softer than the material of the wires and/or the anchor body. Through this measure, the friction at the deflection locations of the wires is indeed reduced in order largely to avoid a friction and corrosion breakage. The friction and the breakage are not completely eliminated, however, precisely for the reason that the spaces between the wires and the respective bore wall are completely filled up with the supporting means and the wires rest closely against the bore walls over the entire length of the bores, so that they cannot oscillate unhindered.

The most-used solution consists in a filling of the anchoring region bonded frictionally to rods, wires or strands of a suspension cable. Such a grouting anchoring is explained in the DE-OS 26 14 821. In the region of the deflection location at the end of the anchor casing facing the bracing plate, a grouting compound of redistilled zinc or zinc alloys is provided for, which exhibits properties preventing frictional corrosion. The function of such a filling consists in gradually carrying off the force of the rods, wires, or strands so that it reaches the deflection location at the bracing plate no longer, or weakened in a harmless manner. Through this measure, the fatigue strength of the rods, the wires, or the strands is by no means increased.

The anchorings described in the two last-mentioned publications relate only to the deflecting forces arising in the region of an anchor body or a bracing plate and by no means solve problems which are caused by deflecting forces acting on the second deflection location, where the individual tension elements are bunched into one member.

The problem which underlay the invention indicated in patent claim 1 was to provide an anchoring of freely oscillating tension elements of steel of a dynamically stressed structural component which makes it possible that the tension elements going through the bores of the anchor body are not exposed to any friction, the force being transmitted to the clamps by means of which the tension elements are anchored in the bores of the anchor body. Thus the deflecting forces on the first deflection location are to be eliminated. Furthermore, the deflecting forces on the second deflection location, where the tension elements run together into a bunch, are also to be eliminated.

The problem is solved in an anchoring according to the generic clause of patent claim 1 by means of the feature of the characterizing part of patent claim 1.

Advantageously, the diameter of each bore is larger by 2 to 5 mm than that of the tension elements. The subject of the invention is explained in more detail below with the aid of the drawing, by way of example.

Figure 2:
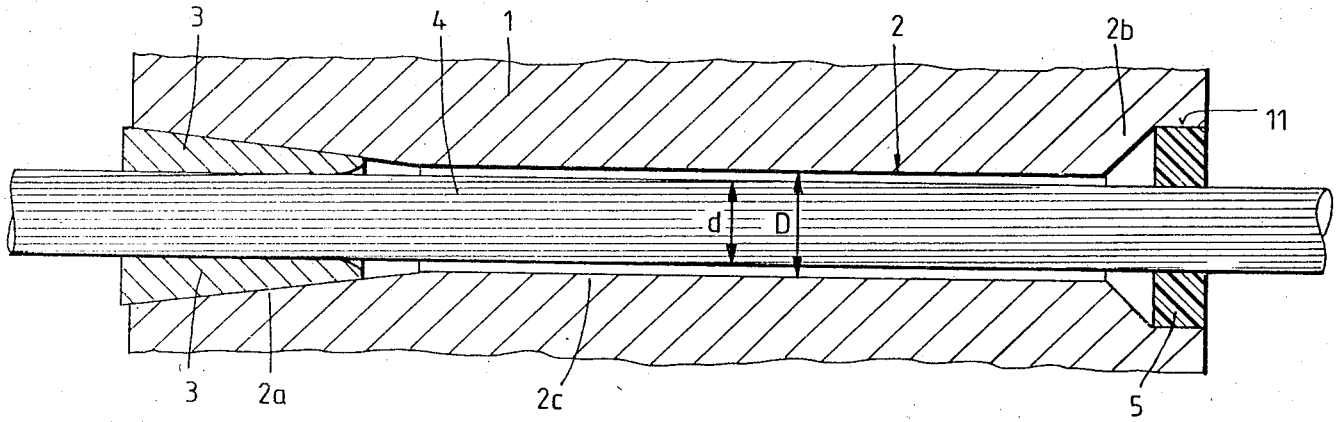
Figure 3:
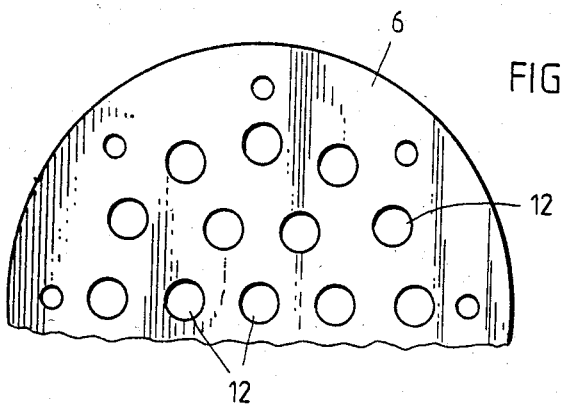
Figure 4:
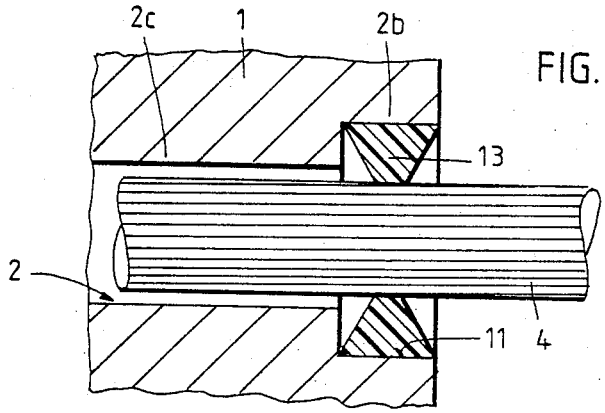
Figure 5:
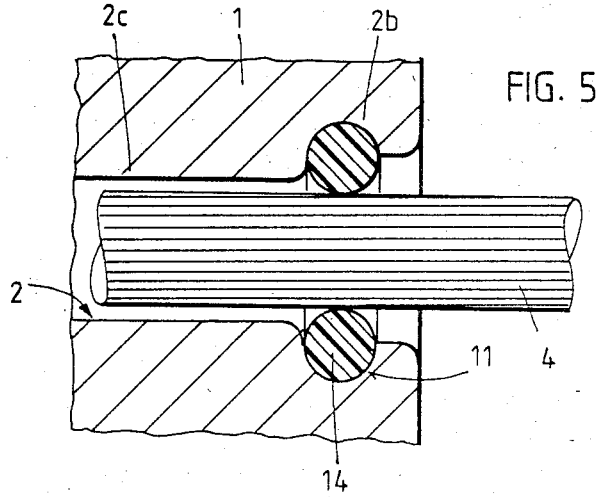

FIG. 1 shows a view, partially in longitudinal section, of an anchoring with twice-deflected tension elements, FIG. 2 shows a partial longitudinal section of another embodiment of the anchoring on a larger scale, in which only the anchor body is represented with a tension element, FIG. 3 shows a side view of a perforated, elastically yielding disc according to FIG. 1, FIG. 4 shows a partial longitudinal section of still a further embodiment in which the anchor body is partially represented only with a bore and a tension element led through it, and FIG. 5 shows a partial longitudinal section of still a further embodiment in which the anchor body is partially represented only with a bore and a tension element led through the bore.

The represented tension member of steel of a dynamically stressed structural component, which tension member is e.g. a freely oscillating suspension cable of a cable-stayed bridge, is fanned out on its end to be anchored into individual tension elements 4 (rods, wires or strands). The part of the tension member to be anchored is disposed in a tubular guide casing 8. The guide casing 8 can be made of plastics or sheet steel and is intended to be embedded in concrete. The end parts of the tension elements 4 are led through bores 2 of an anchor body 1 running parallel to one another. Screwed to the anchor body 1 is a clamping ring 7 which is in turn welded to the guide casing 8. The anchor body 1 is usually made of steel.

The bores 2 exhibit on the one hand spaces 2*a* opening conically outwards in which wedge clamps 3 are inserted, by means of which the end parts of the tension elements 4 are anchored on the anchor body 1. The diameter D of each bore 2 in its section 2*c*, which extends from the space 2*a* up to the exit end 2*b*, is constant and larger than that d of the tension element 4. The diameter D of each bore 2 is larger by 2 to 5 mm than that d of the tension elements 4.

For the purpose of taking-up of deflecting forces in the deflection region of the anchor body 1, oscillatable supporting means are provided for of a material which is softer than the material of the anchor body 1 or of the tension elements 4 resting against the supporting means. The supporting means are provided for only in the region of the exit ends 2*b*. The supporting means can, as is apparent from the FIGS., consist in each case of an elastically yielding ring 5, 13, 14 accommodated in a circular recess 11 in the wall of the exit end 2*b* of each bore 2, which ring oscillates with the tension element 4. Advantageously, the rings 5, 13, 14 are glued to the wall of the circular recess 11. In cross-section the elastically yielding ring 5, 13, 14 can have the shape of a polygon, a trapezoid, or a circle.

Instead of the rings 5, 13, 14, the supporting means can consist of a perforated, elastically yielding disc 6 which is held fast by means of the clamping ring 7 to the anchor body 1, resting against the anchor-body end face, at the exit side of the bores 2. The holes 2 of the disc 6 are aligned with the bores 2 of the anchor body 1 so that the tension elements 4 appearing out of the anchor-body bores 2 pass through the holes 12. In this case, too, as with the rings 5, 13, 14, the hole-edges of the disc 6 rest closely against the tension elements 4. Thus the disc 6 oscillates with the tension elements 4 running through its holes 12.

The fanned-out, anchored tension elements 4, which exit from the anchor-body bores 2, run through a spreader ring 9 disposed in the guide case 8, by means of which ring the tension elements 4 are joined into a bunched, tension member. This is the second deflection location in which deflecting forces act upon the tension elements. For the purpose of taking up the deflecting forces on this second deflection location, the spreader ring exhibits on its surface facing the tension elements 4 an insert 10 resting against the tension elements 4. The material of the insert 10 is softer than that of the spreader ring 9 or the tension elements 4.

It is known that e.g. at a top stress of 50% of the rated tensile strength of the high-grade steel wires or strands of a suspension cable, amplitudes of oscillation are achieved which are greater than or equal to 200 $N/mm^2$. This leads to the wires or strands or rods pressing against the borehole walls, in the direction of the wire-bunch axis, in the anchor-body bores through which they are led and forming a kink upon exit from the anchor body. The same applies to the second deflection location in the region of the spreader ring. Such kinks then lead to a very considerable diminishing of the fatigue strength and finally to the breakage of the wires or the strands or the rods at the deflection locations. As opposed to this, through the free space between the tension elements and the bore walls in the anchor body it is achieved that the tension elements are not subjected to any friction, the traction being transmitted 100% directly to the clamps. Through the measures described above, the fatigue strength and thus the life span of the tension elements is substantially increased both in the first deflection location at the anchor body and also in the second deflection location at the spreader ring.

I claim:

1. Anchoring of freely oscillating tension elements (4) of steel of a dynamically stressed structural component, which tension element (4) are deflected twice in the anchoring region, having an anchor body (1) with bores (2) running parallel to one another, through which the tension elements (4) are led and are anchored by means of wedge clamps (3) at their ends in spaces (2*a*) of the bores (2) opening conically outwards, supporting means against which the tension elements (4) rest being provided for in the deflection region of the anchor body (1) for the purpose of taking-up of deflecting forces, and having a spreader ring (9) for bunching the tension elements (4) exiting from the anchor-body bores (2) and running through the spreader ring (9), characterized in that the diameter (D) of each bore (2) in the section (2*c*) from the space (2*a*) opening conically outwards up to approximately the exit end (2*b*) is constant and larger than that (d) of the tension element (4), that the supporting means are provided for as oscillatable supporting means (5, 13, 14, 6) only in the region of the exit ends (2*b*), and that the spreader ring (8) exhibits on its surface facing the tension elements (4) an insert (10), resting against the tension elements (4), which is made of a softer material than that of the spreader ring (9) or of the tension elements (4).

2. Anchoring according to patent claim 1, characterized in that the diameter (D) of each bore (2) is larger by 2 to 5 mm than that (d) of the tension elements.

3. Anchoring according to patent claim 1, characterized in that the supporting means comprise in each instance an elastically yielding ring (5, 13, 14) accommodated in a circular recess (11) in the wall of the exit end (2*b*) of each bore (2), which ring oscillates with the tension element (4).

4. Anchoring according to patent claim 1, characterized in that the supporting means comprise a perforated, elastically yielding disc (6) which is held fast by means of a clamping ring (7) to the anchor body (1) resting against the anchor-body end face at the exit side of the bores (2) and oscillates with the tension elements (4) running through its holes (12).

5. Anchoring according to patent claim 3, characterized in that each elastically yielding ring (5, 13, 14) is polygonal, trapezoidal, or circular in cross-section.

6. Anchoring means for freely oscillating tension elements (4) of steel of a dynamically stressed structural component, which tension elements (4) are deflected twice in the anchoring region, having an anchor body (1) with bores (2) running parallel to one anoter, through which the tension elements (4) are led and are anchored by means of wedge clamps (3) at their ends in outer end spaces (2*a*) of the bores (2) opening conically outwards, supporting means against which the tension elements (4) rest being provided for in the deflection region of the anchor body (1) for the purpose of taking up of deflecting forces, and having an axially spaced spreader ring means (9) for bunching the tension elements (4) exiting from the anchor-body bores (2) and running through the spreader ring means (9), characterized in that the diameter (D) of each bore (2) in a center section (2*c*) from the space (2*a*) opening conically outwards up to approximately the inner exit end (2*b*) is constant and radially open being larger than that (d) of the tension element (4), that the supporting means are provided for as oscillatatable supporting means (5, 13, 14, 6) on the anchor body only in the region of the exit ends (2*b*), and that the spreader ring means (9) positions the tension elements (4) by an insert (10), resting against the tension elements (4), which insert is made of a softer material than that of the spreader ring (9) or of the tension elements (4) to form a second supporting means for the tension elements.

7. Anchoring according to patent claim 6, characterized in that the said supporting means comprise in each instance an elastically yielding ring (5, 13, 14) positioned in a circular recess (11) in the anchor body of the exit end (2*b*) of each bore (2), which ring oscillates with the tension element (4).

8. Anchoring according to claim 6, characterized in that the said supporting means comprise a perforated, elastically yielding disc (6) which is held fast by means of a clamping ring (7) to the anchor body (1) resting against the anchor-body end face at the exit side of the bores (2) and oscillates with the tension elements (4) running through its holes (12).

* * * * *